US010982670B2

(12) United States Patent
Claywell et al.

(10) Patent No.: US 10,982,670 B2
(45) Date of Patent: Apr. 20, 2021

(54) GEAR PUMP AND GEAR ASSEMBLY

(71) Applicant: GM GLOBAL TECHNOLOGY OPERATIONS LLC, Detroit, MI (US)

(72) Inventors: Mark R. Claywell, Birmingham, MI (US); Sean M. McGowan, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 206 days.

(21) Appl. No.: 16/253,546

(22) Filed: Jan. 22, 2019

(65) Prior Publication Data

US 2020/0232458 A1 Jul. 23, 2020

(51) Int. Cl.

| | |
|---|---|
| ***F04C 2/18*** | (2006.01) |
| ***F04C 15/00*** | (2006.01) |
| ***F04C 11/00*** | (2006.01) |

(52) U.S. Cl.

CPC ..... *F04C 2/18* (2013.01); *F04C 11/001* (2013.01); *F04C 15/0073* (2013.01); *F04C 15/0076* (2013.01)

(58) Field of Classification Search

CPC .... F04C 15/0076; F04C 2/18; F04C 29/0078; F04C 11/001; F04C 15/0073

See application file for complete search history.

(56) References Cited

U.S. PATENT DOCUMENTS

| | | | | |
|---|---|---|---|---|
| 2,965,036 | A * | 12/1960 | Wood | F04C 14/02 417/62 |
| 5,326,232 | A * | 7/1994 | McDonnel | F04C 11/001 417/319 |
| 7,290,995 | B2 * | 11/2007 | Ohnishi | F04C 11/001 29/888.02 |
| 8,496,457 | B2 * | 7/2013 | Varga | F04C 2/18 418/200 |
| 9,784,252 | B2 * | 10/2017 | Berbuer | F04B 1/1072 |
| 2004/0213680 | A1 * | 10/2004 | Suzuki | F04C 11/001 417/310 |
| 2008/0240968 | A1 * | 10/2008 | Chiu | F04C 2/18 418/206.7 |

FOREIGN PATENT DOCUMENTS

| | | | |
|---|---|---|---|
| DE | 97715 | A1 | 5/1973 |
| DE | 102006052322 | A1 | 5/2008 |
| DE | 102008037152 | A1 | 2/2009 |
| DE | 102012001781 | A1 | 7/2012 |
| DE | 102012216122 | A1 | 4/2013 |
| JP | 2009138886 | A * | 6/2009 |

* cited by examiner

*Primary Examiner* — Mary Davis

(57) ABSTRACT

A gear pump that is used to pump fluid, such as oil, in a vehicle. The gear pump comprises a gear assembly having a drive shaft including a drive shaft key; a set of drive gears mounted on the drive shaft, with a drive gear of the set of drive gears being keyed with the drive shaft key; a driven shaft including a driven shaft key; a set of driven gears mounted on the driven shaft, with a driven gear of the driven gear set being keyed with the driven shaft key; and a torque drive feature associated with the drive shaft or the driven shaft, wherein the torque drive feature is configured to check keying with the driven shaft key.

19 Claims, 2 Drawing Sheets

GEAR PUMP AND GEAR ASSEMBLY

INTRODUCTION

The field of technology generally relates to gear pumps, and more particularly, to gear pumps for pumping oil in vehicles.

Gear scavenge pumps facilitate fluid flow using a gear assembly. Oftentimes, one or more drive gears and one or more driven gears in the gear assembly will be different, thereby requiring a different forming tool (e.g., a different powder metallurgy mold or die) for each gear and/or extra machining. Additionally, the drive and driven gear configurations can lead to shaft wear and galling if the drive shaft and the driven shaft do not rotate at the same speed. Maintaining the speed of the driven shaft such that it rotates at gear speed can be desirable.

SUMMARY

According to one embodiment, there is provided a gear pump comprising a gear assembly. The gear assembly has a terminal end and a drive input end. The gear assembly includes a drive shaft including a drive shaft key; a set of drive gears mounted on the drive shaft, wherein a drive gear of the set of drive gears is keyed with the drive shaft key; a driven shaft including a driven shaft key; a set of driven gears mounted on the driven shaft, wherein the set of drive gears is configured to mesh with the set of driven gears to facilitate fluid flow between the set of drive gears and the set of driven gears, wherein a driven gear of the driven gear set is keyed with the driven shaft key; and a torque drive feature associated with the drive shaft or the driven shaft, wherein the torque drive feature is configured to check keying with the driven shaft key.

According to various embodiments, the gear pump may further include any one of the following steps or features or any technically-feasible combination of these steps or features: the driven shaft key is a single driven shaft key; the driven gear of the driven gear set that is keyed with the driven shaft key is located closer to the drive input end than any other driven gears of the set of driven gears; the other driven gears of the set of driven gears are configured to rotate freely with respect to the driven shaft; each drive gear of the set of drive gears are keyed to the drive shaft; the torque drive feature is associated with the drive shaft and a second torque drive feature is associated with the driven shaft; the first and second torque drive features are located at the terminal end of the gear assembly; the first and second torque drive features extend radially from an axial bore of the drive shaft; the first and second torque drive features include a slot extending through the axial bore of the drive shaft; the first and second torque drive features include a second slot extending through the axial bore of the drive shaft; the first and second torque drive features have a hex configuration; one or more plates separate each drive gear of the set of drive gears and each driven gear of the set of driven gears; the drive gear and the driven gear are dimensionally the same; the drive gear and the driven gear are powder metal gears with matching keyways; the driven shaft key is a separate key element that fits in a keyseat in the driven shaft; the driven shaft key is an integral key element that is unitary with the driven shaft; the gear assembly is encased in a housing having a rear end plate configured to cover the terminal end of the gear assembly; a supply pump is encased in the housing with the gear assembly; and/or the gear pump is a vehicle oil pump.

According to another embodiment, there is provided a gear pump comprising a gear assembly having a terminal end and a drive input end. The gear assembly comprises a drive shaft including a drive shaft key; a set of drive gears mounted on the drive shaft, wherein a drive gear of the set of drive gears is keyed with the drive shaft key; a driven shaft including a single driven shaft key; and a set of driven gears mounted on the driven shaft, wherein the set of drive gears is configured to mesh with the set of driven gears to facilitate fluid flow between the set of drive gears and the set of driven gears, wherein a driven gear of the driven gear set is keyed with the driven shaft key, wherein the driven gear of the driven gear set that is keyed with the driven shaft key is located closer to the drive input end than any other driven gears of the set of driven gears.

According to various embodiments, the gear pump may further include any one of the following steps or features or any technically-feasible combination of these steps or features: the other driven gears of the set of driven gears are configured to rotate freely with respect to the driven shaft; and/or the drive shaft includes a first torque drive feature and the driven shaft includes a second torque drive feature, wherein the first torque drive feature and the second torque drive feature are configured to check keying with the driven shaft key.

BRIEF DESCRIPTION OF THE DRAWINGS

Preferred exemplary embodiments will hereinafter be described in conjunction with the appended drawings, wherein like designations denote like elements, and wherein.

DETAILED DESCRIPTION

The gear pump described herein includes a gear assembly that is easy and efficient to manufacture. The gear assembly of the gear pump includes a driven shaft key to ensure the driven shaft rotates with the drive shaft. Additionally, one or more torque drive features are included on the drive shaft and/or the driven shaft to help verify that one of the driven gears, advantageously the one closest to a drive input end of the gear assembly, is properly keyed with the driven shaft key. The gear pump and gear assembly described herein can help address undesirable shaft-related wear.

Figure 1:
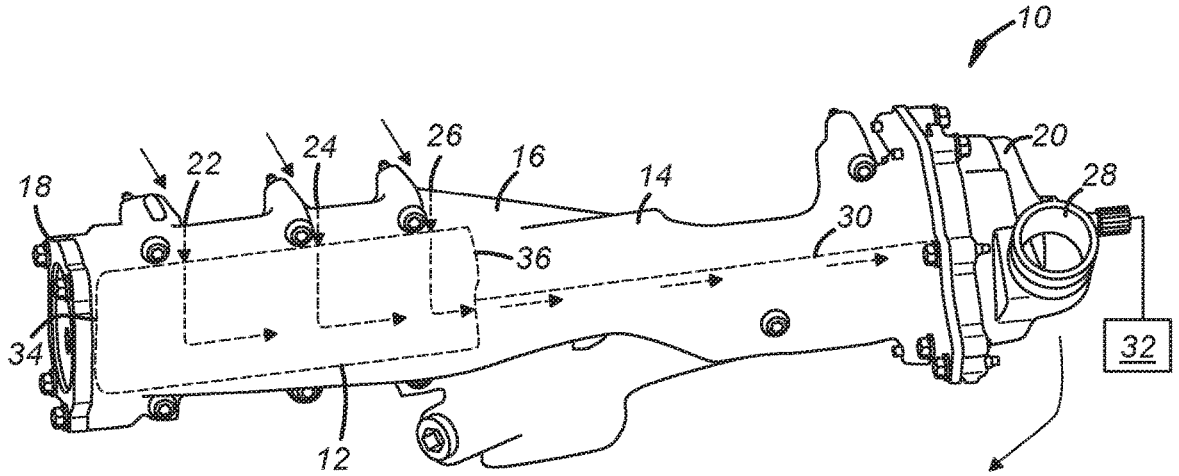
FIG. 1 shows a gear pump in accordance with one embodiment.

FIG. 1 illustrates one embodiment of a gear pump 10, having a gear assembly 12. The gear assembly 12 is schematically illustrated in FIG. 1, as it is advantageously encased in a housing 14. The housing 14 includes a main axially extending body 16, and in this embodiment, includes a rear end plate 18 located a first end of the axially extending body 16 and a supply pump 20 located at the opposite end of the axially extending body. The housing 14 may be shaped differently and may depend on the configuration of the gear assembly 12. It is also possible to not include a separate supply pump, or to include other pumps, inlets, outlets, etc. that are not illustrated particularly in FIG. 1.

In an advantageous embodiment, the gear pump 10 is a vehicle oil scavenge pump configured to pump oil through inlets 22, 24, 26 through the gear assembly 12, up to the supply pump 20, and out of the outlet 28. The arrows in FIG. 1 schematically illustrate fluid flow through the gear pump 10. The gear assembly 12 of the gear pump 10 is connected via one or more shafts 30 to an external drive mechanism 32, which in one embodiment, is the vehicle crankshaft. Other gear mechanisms, shafts, belts, chains, sprockets, etc. may be included to facilitate operation of the gear pump 10.

Figure 2:
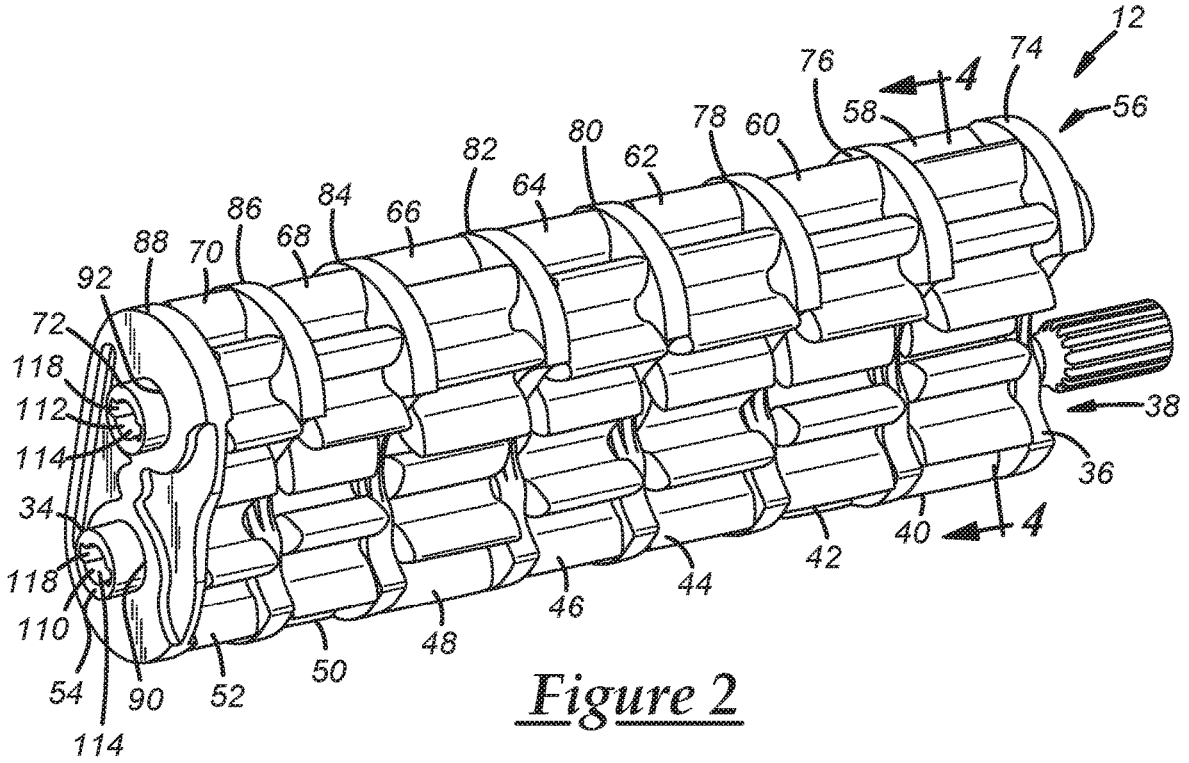
FIG. 2 shows a gear assembly from the gear pump of FIG. 1.

FIG. 2 illustrates the gear assembly 12. The gear assembly 12 has a terminal end 34 and a drive input end 36. The terminal end 34 directly opposes the rear end plate 18. In some embodiments, various springs, dampers, etc. may be included at least partially between the terminal end 34 of the gear assembly 12 and the rear end plate 18 of the housing 14. The gear assembly 12 includes a set 38 of drive gears 40-52 mounted on a drive shaft 54 and a set 56 of driven gears 58-70 mounted on a driven shaft 72. The set of drive gears 38 is configured to mesh with the set of driven gears 56 to facilitate fluid flow between the set of drive gears and the set of driven gears. The drive shaft 54 can be mounted to the shaft 30, schematically illustrated in FIG. 1, so it can be rotated by the external drive mechanism 32. Rotation of the drive shaft 54 facilitates rotation of the drive gears 40-52, which then rotate the driven gears 58-70, as detailed further below.

Figure 3:
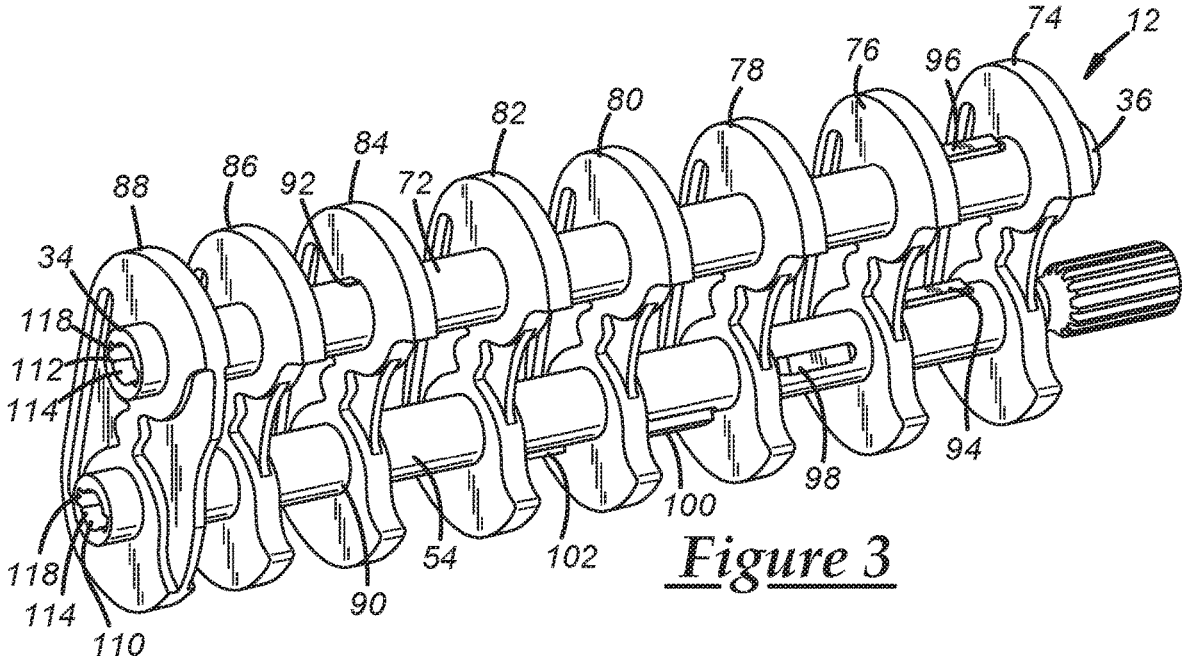
FIG. 3 shows the drive shaft and the driven shaft from the gear assembly of FIG. 2.

With reference to FIGS. 2 and 3, the drive gears 40-52 and the driven gears 48-80 are separated by plates 74-88. A first plate 74 is located at the drive input end 36; a second plate 76 separates gear pair 40, 58 from gear pair 42, 60; a third plate 78 separates gear pair 42, 60 from gear pair 44, 62; a fourth plate 80 separates gear pair 44, 62 from gear pair 46, 64; a fifth plate 82 separates gear pair 46, 64 from gear pair 48, 66; a sixth plate 84 separates gear pair 48, 66 from gear pair 50, 68; a seventh plate 86 separates gear pair 50, 68 from gear pair 52, 70; and an eighth plate 88 is located at the terminal end 34 of the gear assembly 12. The number of gears in each gear set 38, 56 may be more than what is illustrated in the figures, or the gear assembly 12 could have fewer gears than illustrated. The number of plates can vary depending on the number of gears in the gear assembly 12. Each plate 74-88 includes a drive shaft bearing surface 90 and a driven shaft bearing surface 92 (the bearing surfaces 90, 92 are only labeled on one plate in each of FIGS. 2 and 3 for clarity purposes). The shaft and gear features described herein can help promote better lubrication of the drive shaft bearing surface 90 and the driven shaft bearing surface 92 during operation of the gear pump 10.

Figure 4:
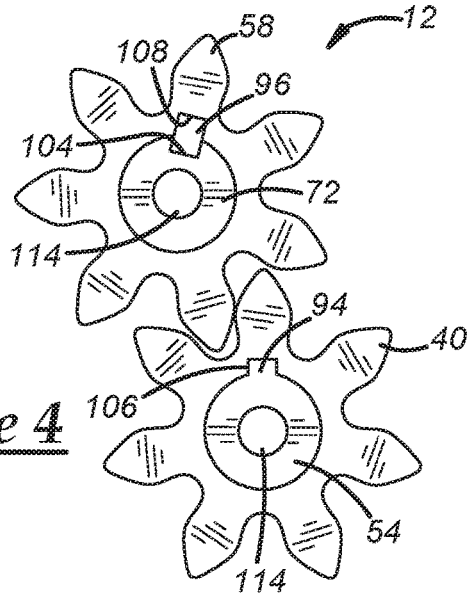
FIG. 4 is a cross section of the gear assembly of FIG. 2, taken along line 4-4 in FIG. 2.

As shown in FIGS. 3 and 4, the gear assembly 12 includes a drive shaft key 94 associated with the drive shaft 54 and a driven shaft key 96 associated with the driven shaft 72. The drive shaft key 94 and the driven shaft key 96 can help ensure that the gears 40 and 58, respectively, rotate with their respective shafts 54, 72. In an advantageous embodiment, all of the drive gears 40-52 of the set 38 are keyed to the drive shaft 54. Additional drive shaft keys 98, 100, 102 are shown in FIG. 3, and the drive shaft keys for the other drive gears 48, 50, 52 are circumferentially spaced on the backside of the drive shaft 54 such that they are not visible in the FIG. 3 view. Accordingly, each drive gear 40-52 is keyed to the drive shaft 54 via a plurality of drive shaft keys 94, 98, 100, 102 that are circumferentially spaced around an outer perimeter of the drive shaft. The drive shaft keys 94, 98, 100, 102 force each drive gear 40-52 to rotate with rotation of the drive shaft 54.

In some gear pumps, the driven shaft is allowed to freely rotate with respect to the set of driven gears. Accordingly, the driven shaft often rotates at a speed that is less than gear speed. With the gear pump 10, however, the driven shaft key 96 keys the driven gear 58 to the driven shaft 72. In an advantageous embodiment, the driven shaft key 96 is a single driven shaft key that keys the gear 58 that is closest to the drive input end 36. The other driven gears 60-70 are permitted to rotate freely with respect to the driven shaft 72. In other words, the other driven gears 60-70 are not keyed to the driven shaft 72. This single key arrangement still forces the driven shaft 72 to rotate, thereby ensuring the gears 60-70 rotate without relative motion between the driven shaft and the driven gears, which can reduce gear/shaft wear or galling. Rotating the driven shaft 72 at gear speed via the driven shaft key 96 helps promote a more stable oil film at the bearing surface 92 along each plate 74-88. Moreover, locating the driven shaft key 96 near the drive input end 36 helps provide additional torsional damping.

FIG. 4 is a cross-section view of the gear assembly 12 taken at line 4-4 in FIG. 2. FIG. 4 shows various key configurations that may be used for drive or driven shaft keys. In an advantageous embodiment, the key configuration is the same for all of the shaft keys 94-102, but FIG. 4 shows two different implementations for example purposes that could be used with any or all of the shaft keys 94-102. In the illustrated embodiment, the drive shaft key 94 is an integral key element that is unitary with the drive shaft. This embodiment may be better suited for extruded or cast shafts. In a more advantageous embodiment, the driven shaft key 96 is a separate key element that fits in a keyseat 104 of the driven shaft 72. The keyseat 104 can be machined or otherwise formed in the outer diameter of the shaft. The shaft key 94-102 can have a standard, rectangular shape, or it can be more tapered to have a wider base towards the keyseat 104. In another embodiment, the shaft key 94-102 is a dowel or another locking feature that prevents relative rotation between the respective gear and shaft.

As shown in FIG. 4, each shaft key 94, 96 fits into a respective keyway 106, 108 in the gears 40, 58. Keying the driven gear 58 allows for the drive gear 40 and the driven gear 58 to be dimensionally the same, as they have matching keyways 106, 108. In an advantageous embodiment, the gears 40-52 and 58-70 are powder metal spur gears. Having the gears 40, 58 be dimensionally the same allows for them both to be formed in the same powder metallurgy mold or die, and can be easier when installing the gears on their respective shafts, as the same gear can be mounted on both the drive shaft 54 and the driven shaft 72. In some embodiments, such as the one illustrated, some of the gears, such as gears 46, 50, 52, 64, 68, 70, have different widths than the other gears in the respective gear sets. The widths of the gears can be adjusted depending on the desired fluid flow characteristics.

To verify that the driven gear 58 is properly keyed to the driven shaft 72, a first torque drive feature 110 that is associated with the drive shaft 54 and a second torque drive feature 112 that is associated with the driven shaft 72 can be used. In an advantageous embodiment, the torque drive features 110, 112, are located at the terminal end 34 of the gear assembly 12 at the end of each respective shaft 54, 72. Locating the torque drive feature 110, 112 at the terminal end 34 allows the keying to be easily checked during the manufacturing process, as the keying can be checked after the gear assembly 12 is inserted into the axially extending body 16 of the housing 14 and before the rear end plate 18 is installed. To complete the keying verification process, a tool (e.g., a screwdriver or another tool depending on the configuration of the torque drive feature) can be inserted into the torque drive feature 110 to stop rotation of the drive shaft 54. With the drive shaft rotation stopped, the rotation of the driven shaft 72 also stops since the driven gear 58 is keyed with the driven shaft key 96 to the driven shaft. If the driven gear 58 is not properly keyed with the driven shaft 72, the driven shaft will keep rotating when the drive shaft 54 is stopped. Additionally, the torque drive feature 112 can be used to stop rotation of the driven shaft 72. If the driven shaft rotation can be stopped without causing a corresponding stoppage in the rotation of the drive shaft 54, it can be determined that the driven shaft 72 is not properly keyed.

Figure 5:
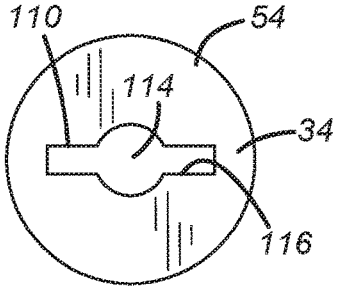
FIG. 5 shows a torque drive feature from the gear assembly of FIG. 2.
Figure 6:
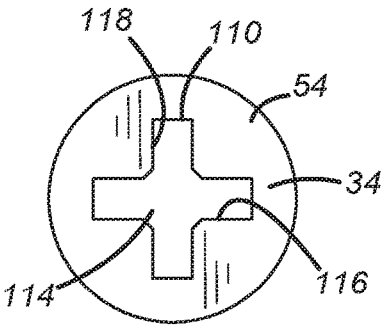
FIG. 6 shows another embodiment of a torque drive feature.
Figure 7:
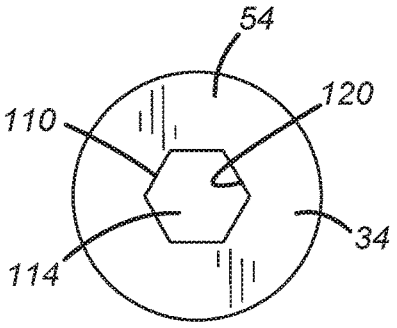
FIG. 7 shows yet another embodiment of a torque drive feature.

FIGS. 5-7 illustrate various example configurations for the torque drive feature 110, which are also applicable to the second torque drive feature 112. Accordingly, teachings with respect to the torque drive feature 110 are also applicable to the torque drive feature 112. Having the same torque drive feature 110, 112, in both the drive shaft 54 and the driven shaft 72 can be desirable from a manufacturing standpoint and allows the same tooling to be used in the keying verification process. In an advantageous embodiment, the torque drive feature 110 radially extends from an axial bore 114 of the shaft 54. In some embodiments, however, where the shaft does not have a through bore and instead has a solid configuration, the torque drive feature may be a smaller recessed portion at the terminal end 34. Containing the torque drive feature within a recessed portion of the shaft at the terminal end 34 can help minimize contact with end cover springs and can help maximize shaft end thrust face area. In FIG. 5, the torque drive feature 110 includes a slot 116 that extends through the axial bore 114. In FIG. 6, the torque drive feature 110 includes the slot 116 along with a second slot 118 that is oriented orthogonally with respect to the first slot 116 so as to equidistantly radiate from the axial bore 114. In FIG. 7, the torque drive feature 110 includes a hex configuration 120. Other torque drive feature configurations are certainly possible, so long as they help restrict movement of the shaft to help verify keying.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the specific combination and order of steps is just one possibility, as the present method may include a combination of steps that has fewer, greater or different steps than that shown here. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A gear pump, comprising:

a gear assembly having a terminal end and a drive input end, the gear assembly comprising:

a drive shaft including a drive shaft key;

a set of drive gears mounted on the drive shaft, wherein a drive gear of the set of drive gears is keyed with the drive shaft key;

a driven shaft including a driven shaft key;

a set of driven gears mounted on the driven shaft, wherein the set of drive gears is configured to mesh with the set of driven gears to facilitate fluid flow between the set of drive gears and the set of driven gears, wherein a only one driven gear of the driven gear set is keyed with the driven shaft key; and a torque drive feature associated with the drive shaft or the driven shaft, wherein the torque drive feature is configured to check keying with the driven shaft key, the torque drive feature being at the terminal end of the gear assembly and being a recessed portion at an end of either the drive shaft or the driven shaft, wherein the driven shaft key is a single driven shaft key, and wherein the only one driven gear of the driven gear set that is keyed with the driven shaft key is located closest to the drive input end than any other driven gears of the set of driven gears.

2. The gear pump of claim 1, wherein the other driven gears of the set of driven gears are configured to rotate freely with respect to the driven shaft.

3. The gear pump of claim 1, wherein each drive gear of the set of drive gears are keyed to the drive shaft.

4. The gear pump of claim 1, further comprising a second torque drive feature, wherein the torque drive feature is associated with the drive shaft, and the second torque drive feature is associated with the driven shaft, wherein the torque drive feature and the second torque drive feature are located at the terminal end of the gear assembly.

5. The gear pump of claim 4, wherein the torque drive feature extends radially from an axial bore of the drive shaft, and the second torque drive feature extends radially from an axial bore of the driven shaft.

6. The gear pump of claim 5, wherein the torque drive feature is a slot extending through the axial bore of the drive shaft, and the second torque drive feature is a slot extending through the axial bore of the driven shaft.

7. The gear pump of claim 6, wherein the torque drive feature includes a second slot extending through the axial bore of the drive shaft, and the second torque drive feature includes a second slot extending through the axial bore of the driven shaft.

8. The gear pump of claim 4, wherein the torque drive feature has a hex configuration, and the second torque drive feature has a hex configuration.

9. The gear pump of claim 1, wherein one or more plates separate each drive gear of the set of drive gears and each driven gear of the set of driven gears.

10. The gear pump of claim 1, wherein the drive gear and the driven gear are dimensionally the same.

11. The gear pump of claim 10, wherein the drive gear and the driven gear are powder metal gears with matching keyways.

12. The gear pump of claim 1, wherein the driven shaft key is a separate key element that fits in a keyseat in the driven shaft.

13. The gear pump of claim 1, wherein the driven shaft key is an integral key element that is unitary with the driven shaft.

14. The gear pump of claim 1, wherein the gear assembly is encased in a housing having a rear end plate configured to cover the terminal end of the gear assembly.

15. The gear pump of claim 14, wherein a supply pump is encased in the housing with the gear assembly.

16. The gear pump of claim 1, wherein the gear pump is a vehicle oil pump.

17. A gear pump, comprising:

a gear assembly having a terminal end and a drive input end, the gear assembly comprising:

a drive shaft including a drive shaft key;

a set of drive gears mounted on the drive shaft, wherein a drive gear of the set of drive gears is keyed with the drive shaft key;

a driven shaft including a single driven shaft key;

a set of driven gears mounted on the driven shaft, wherein the set of drive gears is configured to mesh with the set of driven gears to facilitate fluid flow between the set of drive gears and the set of driven gears, wherein only one driven gear of the driven gear set is keyed with the driven shaft key, wherein the driven gear of the driven gear set that is keyed with the driven shaft key is located closer to the drive input end than any other driven gears of the set of driven gears; and a torque drive feature associated with the drive shaft or the driven shaft, wherein the torque drive feature is configured to check keying with the driven shaft key, the torque drive feature being at the terminal end of the gear assembly and being a recessed portion at an end of either the drive shaft or the driven shaft, wherein the driven shaft key is a single driven shaft key, and wherein the only one driven gear of the driven gear set that is keyed with the driven shaft key is located closest to the drive input end than any other driven gears of the set of driven gears.

18. The gear pump of claim 17, wherein the other driven gears of the set of driven gears are configured to rotate freely with respect to the driven shaft.

19. The gear pump of claim 17, wherein the drive shaft includes a first torque drive feature and the driven shaft includes a second torque drive feature, wherein the first torque drive feature and the second torque drive feature are configured to check keying with the driven shaft key.

* * * * *